US005934483A

United States Patent [19]

Kolacz

[11] Patent Number: 5,934,483

[45] Date of Patent: Aug. 10, 1999

[54] BI-CHAMBER AIR CLASSIFIER WITH COAXIAL ASCENDING DISPERSED FEED

[75] Inventor: Jacek Kolacz, Trondheim, Norway

[73] Assignee: Sinvent A/S, Norway

[21] Appl. No.: 08/930,783

[22] PCT Filed: Mar. 21, 1996

[86] PCT No.: PCT/NO96/00062

§ 371 Date: Dec. 17, 1997

§ 102(e) Date: Dec. 17, 1997

[87] PCT Pub. No.: WO96/31294

PCT Pub. Date: Oct. 10, 1996

[30] Foreign Application Priority Data

Apr. 7, 1995 [NO] Norway ..... 951366

[51] Int. Cl.[6] ..... B04B 5/12; B04C 5/14

[52] U.S. Cl. ..... 209/714; 209/713; 209/720; 209/722

[58] Field of Search ..... 209/713, 714, 209/720, 722

[56] References Cited

U.S. PATENT DOCUMENTS

| | | | |
|---|---|---|---|
| 2,460,938 | 2/1949 | Koehne | 209/713 |
| 2,577,295 | 12/1951 | Ahlmann | 209/722 |
| 2,968,401 | 1/1961 | Sheldon . | |
| 4,211,641 | 7/1980 | Jager | 209/714 |
| 4,260,478 | 4/1981 | Hosokawa et al. . | |
| 4,337,068 | 6/1982 | MacLean et al. | 209/720 |
| 4,470,902 | 9/1984 | Yoshimori | 209/713 |
| 4,528,091 | 7/1985 | Nied et al. . | |
| 4,842,145 | 6/1989 | Boadway | 209/720 |
| 4,869,786 | 9/1989 | Hanke | 209/714 |

FOREIGN PATENT DOCUMENTS

| | | |
|---|---|---|
| 920704 | 11/1954 | Germany . |
| 2036891 | 1/1974 | Germany . |

*Primary Examiner*—William E. Terrell
*Assistant Examiner*—Joe Dillon, Jr.

[57] ABSTRACT

Apparatus of theforced air vortex type for classification of particulate material into a fine portion and a coarse portion, the apparatus comprising a truncated cone shaped upper section (101) comprising a separating wheel (111) rotating about a substantially vertical axis, a vertically arranged inlet pipe (106) for supplying a particulate material dispersed in an air flow, a conical feed distributor (107) having a tip end directed downwards and arranged concentrically with the inlet pipe (106) and the separating wheel, and a spiral shaped outlet (102) for removal of classified fine material dispersed in air, and a substantially truncated cone shaped lower section (103), the upper section of which exhibiting a secondary air inlet (105) arranged tangential to the circumference of the lower housing (103) to supply secondary air in a direction concurrently with the direction of rotation of the separating wheel (111) and a second outlet (104) for classified coarse particulate material.

4 Claims, 3 Drawing Sheets

BI-CHAMBER AIR CLASSIFIER WITH COAXIAL ASCENDING DISPERSED FEED

Figure 1:
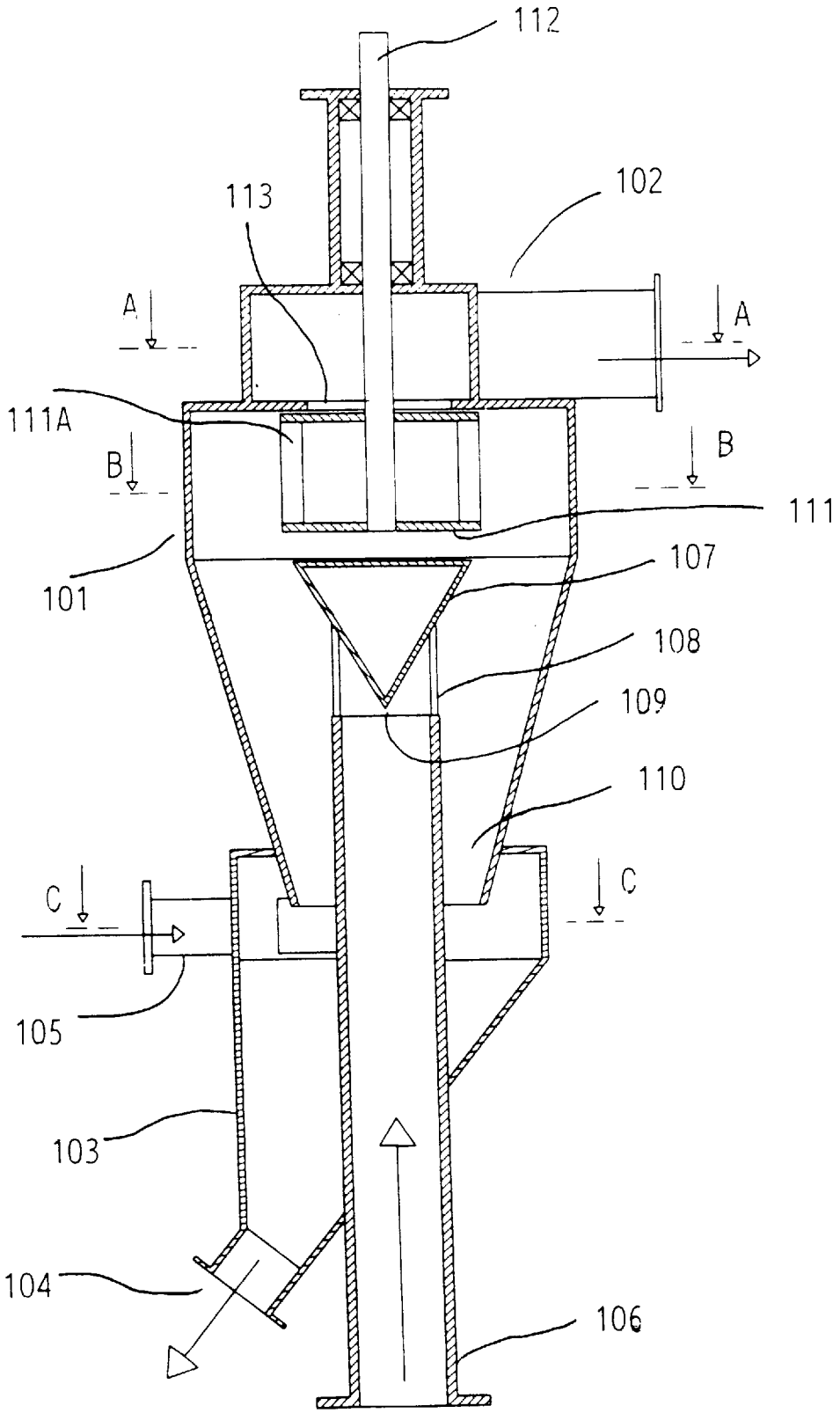

The present invention concerns an apparatus for classifying particulate material, as presented in the introductory of claim 1.

BACKGROUND

Particle classification processes are of critical importance for many grinding circuits. In general, the energy consumption for grinding circuits can be reduced drastically as classification efficiency is high. Ideal classification can be defined as the separation of particle stream into two frictions, one containing only fine material (below a specified size) and the second of only coarse particles. However, in practice, some grains of the feed to the classifier can be taken both to the coarse and to the fine stream. The contents of fine material in the coarse stream and coarse material in the fine stream gives a measure of classification efficiency or classification sharpness. The amount of coarse material in the fine fraction is determined mainly by rotor construction. In practice, rotor classifiers (forced vortex) provide very low contens of coarse material in the fine stream. On the other hand, the amount of fine material in the coarse stream is very different for many classifiers as it depends on its construction. This is the main indicator of the classification efficiency.

U.S. Pat. No. 4,260,478 discloses an apparatus for classifying particles comprising a body having a fine particle outlet at the top of the apparatus and a coarse particle outlet at the bottom. An air flow comprising dispersed unclassified material is supplied to the classification zone from below through a vertically arranged supply pipe. The classification zone is provided with two co-axially arranged rotors or separating wheels, in which the inner rotor is provided with a feed cone which co-rotates with the same. The feed cone is arranged to disperse the material into the classification zone. This construction has several disadvantages; first, the feed cone is subject to high wear due to high impact force between the rotating feed cone and the upward flowing unclassified material. After a certain time of operation, the cone may exhibit un-evenly distributed grooves and similar in the external surface of the same, which may create unbalance and wear of the rotor blade bearings and the engine connected with the same, and second, the outlet section for removal of air and fine classified material from the classification zone is shaped as an ordinary 90° bend, which result in a friction loss and for that reason higher energy consumption at the air supply end of the classification process. Moreover, as the largest diameter of the feed cone is smaller than the lower diameter of the inner rotor blades, material will contact the rotor blades and result in a wear of the same.

A similar apparatus is disclosed in U.S. Pat. No. 2,968,401. Here, there is no air supply pipe arranged vertically within the classification zone, and the material to be classified is supplied directly into the classification zone dispersed in an air flow. The latter construction produces low classification efficiency as fine material is mixed with unclassified material. As with the first mentioned prior art construction, the feed cone is fixed to the rotor blades and co-rotates with the same. Moreover, the single point radial supply of material to be classified provides a poor degree of dispersion. This construction, however, is provided with a spiral shaped oulet for fine material, which reduces the friction loss as the centrifugal force is converted to unidirectional kinetic energy.

DE Patent No. 920.704 discloses a particle separator of the similar type as described above. This construction, however, represents an early stage in the development of such apparatuses, and produces a poor classification efficiency, mainly due to the small volume available to classification. Also in this construction, the rotor blades are subject to wear as the particle feed contacts the blades directly.

The closes prior art is considered to be represented by U.S. Pat. No. 4,528,091, which is the preferred construction in commercial utilization, particularly with regard to classification efficiency.

The classification zone is provided with four rotor units distributed in a horisontal plane in an equal mutual distance, and the rotors rotates about a horisontal axis. Here, a stationary feed cone is provided below the rotors. A vertically arranged supply pipe for partly classified material, from the secondary classification zone below, dispersed in an air flow is located beneath the feed cone. The supply pipe exhibits a truncated cone shaped upper section and a sylindrically shaped lower section which terminates above a secondary classification zone. The secondary classification zone is supplied with air flowing tagentially into the same, and is provided with a further rotor unit arranged coaxially with the longitudinal axis of the main apparatus.

Material to be classified is supplied to the classification zone with a screw conveyor into the annular section establised by the internal casing of the apparatus and the external surface of the supply pipe.

Also this construction has several disadvantages. First, the peripheral supply of material feed results in a poor dispersion of the particulate material in the air, which again results in a lower classification efficiency, and second, the arrangement of the secondary classification zone will establish a stationary (non-rotating) zone at the axis of rotation of air and dispersed particulate material, which further decreases the classification efficiency.

Accordingly, there is a need in the art for an apparatus which, in addition to a high classification efficiency, provides a low operation cost as compared with the existing technical solutions.

OBJECT

The object of the present invention is to provide an apparatus of the type described above which avoids the disadvantages connected with the respective constructions.

THE INVENTION

The object above is achieved with an apparatus according to the characterizing portion of claim 1. Further preferred embodiments appears from the dependent claims.

The present invention concerns an apparatus of the type forced vortex air for classification of particulate material into a fine portion and a coarse portion, the apparatus comprising:

an upper section, having a substantially truncated cone shape and comprising a separating wheel rotating about a substantially vertical axis, inlet means for air and particulate material to be classified, and a first outlet for air and classified fine particulate material, and a lower section, having a substantially truncated cone shape and comprising a second outlet for classified coarse particulate material, and a secondary air inlet, the lower section being in fluid communication with the upper section and having an upper diameter larger than the diameter of the lower end of the upper section.

According to the invention the apparatatus comprises in combination:

a spiral shaped outlet for removal of classified fine material dispersed in air, an inlet pipe for supplying particulate material dispersed in an air flow, the inlet pipe being arranged with its longitudinal axis substantially vertically and within the classification apparatus housing and extending from a distance below the separating wheel down through the lower section of the classification apparatus housing, a feed distributor having a tip end directed downwards and arranged substantially concentrically with the inlet pipe and the separating wheel, and optionally connected to the upper end of the inlet pipe by means of at least two connection elements, such as bars and similar, the feed distributor is dimensioned and arranged in a distance below the separating wheel in a manner that directs the feed of unclassified material beyond the separating wheel, and a secondary classification zone comprising a substantially funnel shaped lower housing, the upper section of which exhibiting a secondary air inlet arranged tangential to the circumference of the lower housing to supply secondary air in a direction cocurrently with the direction of rotation of the separating wheel.

The classifier according to the invention provides high efficiency of classification, thanks to its construction:

the substantially vertically arranged inlet pipe provides good dispersion of the feed in the air supply, and produces no collision between the feed and the classified coarse stream. Accordingly, the inlet pipe results in a high classification efficiency;

the spiral shaped outlet for the fine fraction converts the circulating air flow into a straight substantially turbulent flow, which reduces the friction loss which appears with outlet fittings in the form of a straight pipe or an ordinary bend, the supply of secondary air provides high classification efficiency by separating any fine material connected to the coarse material which is falling down through the upper section and thereafter through the lower section, and the feed cone, which is attached to the inlet pipe, provides uniform distribution of the feed material around the rotor, and good dispersion in the air before the classification starts. As the feed cone is static with regard to the rotor and to the air feed containing unclassified material, very little wear will appear on the surface of the feed cone. Moreover, the arrangement of the feed distributor in relation to the separating wheel prevents the particles to be classified from colliding with the separating wheel, thus establishing a proper dispersion of particulate material in the classification zone and avoiding wear to the separating wheel.

Figure 2:
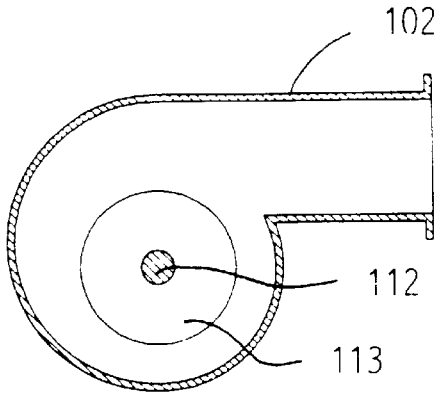
Figure 3:
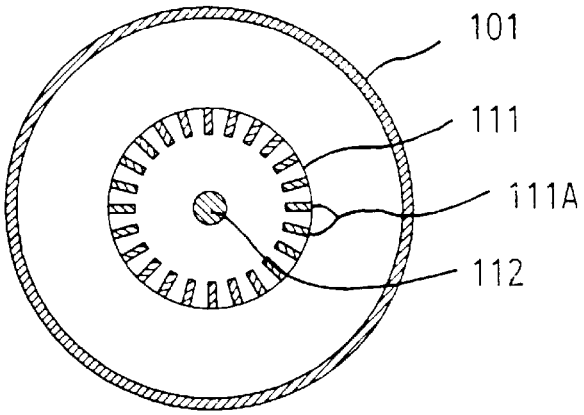
Figure 4:
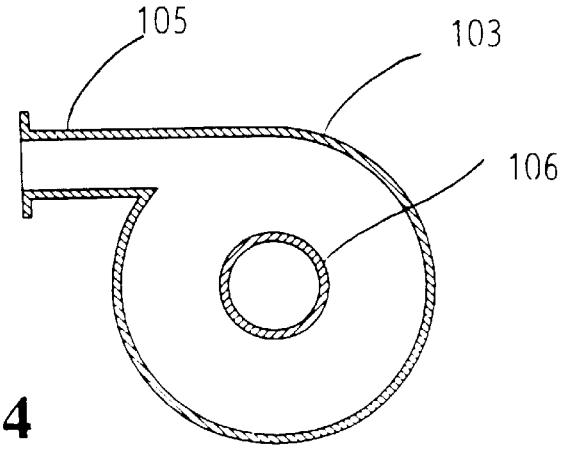
Figure 5:
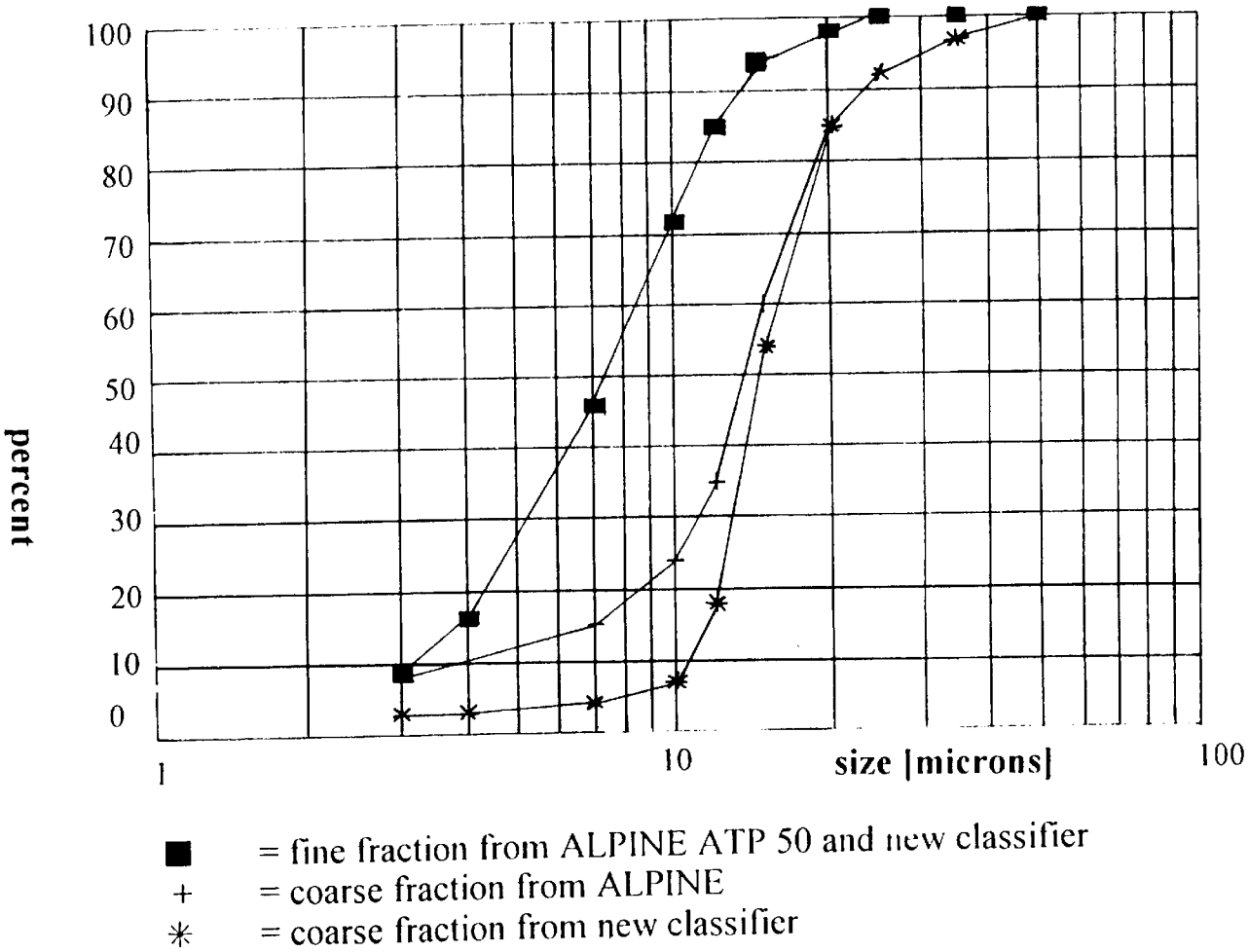

In the following, the invention is described in further details with reference to figures, in which FIG. 1 is a schematic view which illustrates an embodiment of the apparatus according to the invention in a longitudinal cross section, FIG. 2 is a cross sectional view taken along the line A—A of FIG. 1, perpendicular to the longitudinal axis of the apparatus, of the spiral shaped outlet for air and coarse material, FIG. 3 is a cross sectional view taken along the line B—B of FIG. 1, perpendicular to the longitudinal axis of the apparatus, of the primary classification zone, FIG. 4 is a cross sectional view taken along the line C—C of FIG. 1, perpendicular to the longitudinal axis of the apparatus, of the secondary air inlet, and FIG. 5 is a diagram which illustrates the particle size distribution obtained by classification with an apparatus according to the invention and a prior art apparatus.

According to FIG. 1, the feed material enters the classifier mixed with the air through the vertical pipe 106. Then, it is distributed inside the upper section 101 of the classifier by the feed distributor 107. As the material approaches the rotor 111, connected via a shaft 112 to a drive means (not shown), the fine material is captured by the air flow and travels through the rotor blades 111*a* and into the spiral shaped outlet section 102 via aperture 113 and leaves the classifier together with the main air stream.

In FIG. 1, which shows a preferred embodiment, the feed distributor 107 is illustrated as a cone arranged with its tip end downwards and with a upper end diameter slightly less than the external diameter of the separating wheel. The feed distributor is arranged at a certain distance below the separating wheel so that an imaginary cone (not illustrated) established as an extension of the real cone 107 envelop or at least touch the lower end of the separating wheel. In this manner, the particulate material to be classified is directed close to the separating wheel but prevents the particles from colliding with the separating wheel. The shape and arrangment of the feed distributor is however dependent on the air speed and the wear tolerance of the distributor material.

Accordingly, a feed cone having a relatively smaller diameter will have to be arranged at a greater distance below the separating wheel, and a feed cone having the same diameter as the separating wheel can be arranged very close to the separating wheel. However, other shapes are also conceivable: a cone having a longitudinally arched surface, which directs the flow more radially than a cone of the samt height and diameter having a 'plane' surface. The latter construction enables the feed distributor to be arranged close to the separating wheel.

The coarse material is rejected outside the rotor 111 due to the centrifugal forces and falls down to the coarse fraction collection zone 110, and further to the discharging zone 103. After the coarse fraction collecting zone 110, the material is additionally rinsed from the fine grains t)y secondary air 105 which enters the lower section or discharging cone 103 tangentially. The presence of the supply pipe 106 at the secondary air inlet 105 prevents the establishment of a stationary air zone, as discussed in the prior art section above. The fine grains removed from the surface of the coarse grains can then be taken up to the rotor area by the air flowing upwards to the primary classification zone.

FIG. 2 illustrates the outlet 102 of the classification apparatus taken radially with regard to the longitudinal axis of the apparatus. The outlet communicates with the primary classification zone via an aperture 113 in the lower section of the outlet housing 102, and the shaft of the rotor or separating wheel 111 is indicated at 112. As the air coming from the separating wheel through the opening 113 flows through the outlet zone, here in clock-wise direction, the centrifugal forces gradually are converted to straight forward flow, thus reducing the friction loss which is experienced with outlets shaped as for example a 90° bend.

FIG. 3 illustrates the primary classification zone in a view similar to FIG. 2, in which the upper housing is indicated at 101, the rotor at 111 having a number of substantially radially directed blades, and a shaft 112.

FIG. 4 illustrates the secondary classification zone in a view similar to the FIGS. 2 and 3, where the secondary air inlet is indicated at 105, attached tangentially to the periphery of the lower section 103. As the inlet pipe 106 for air and material to be classified occupies the central portion of the secondary classification zone, there will be no occurence of a stationary air core which may restrain the performance of the classifier.

EXAMPLE

The present example is provided in order to illustrate the improved operation of the apparatus according to the invention compared with the preferred prior art apparatus represented by U.S. Pat. No. 4,528,091 mentioned above, hereinafter described as the Alpine system. The respective apparatuses were used to classify particulate silicon carbide. The process parameters, which are summarized in the Table below, were adjusted to obtain as even conditions as possible, i.e., same amount of air per opening area of the rotor, and same concentration of feed in the air stream.

| Parameters | Alpine | Invention |
|---|---|---|
| Main air flow rate ($m^3/h$) | 45 | 340 |
| Feed rate (kg/h) | 7 | 52 |
| Rotor diameter (mm) | 50 | 135 |
| Air flow rate in $m^3/h$ per rotor opening area in $cm^2$ | 1.5 | 1.5 |
| Concentration of feed in the air ($kg/m^3$) | 0.15 | 0.15 |

FIG. 5 illustrates the result of the classification. Despite the very low concentration of feed in the air (0.15 $kg/m^3$) during classification, the coarse fraction classified in the prior art apparatus contains a lot of fine grains which normally should be classified to the fine fraction. The present apparatus, however, results in a very narrow particle size distribution, as is evident from the figure. The result with regard to the fine fraction is however the same for both apparatuses.

For many manufacturers, particularly producers of abrasives, it is of severe importance that the classified material exhibts a narrow particle size distribution. A more efficient classification also provides higher capacity and energy efficient grinding in grinding systems employing classifiers working in closed circuits.

Accordingly, the present invention provides an apparatus which result in a more efficient classification and a product of higher quality, and thanks to the arrangement of the coarse fraction outlet, the supply pipe and the secondary air, the reduced friction loss provides a more energy efficient classification.

We claim:

1. Apparatus of the forced air vortex type for classification of particulate material into a fine portion and a coarse portion, the apparatus comprising:

a classification apparatus housing (101, 103) comprising an upper section (101) having a substantially truncated cone shape and comprising a squirrel-cage separating wheel (111) rotating about a substantially vertical axis, an inlet for air and particulate material to be classified, and a first outlet (102) for air and classified fine particulate material, and a lower section (103) having a substantially truncated cone shape and comprising a second outlet (104) for classified coarse particulate material, and a secondary air inlet (105), the first outlet comprising a spiral shaped outlet (102) for removal of classified fine material dispersed in air, the inlet for air and particulate material to be classified comprising an inlet pipe (106) adapted to be coupled to a stream of particulate material dispersed in an air flow, the inlet pipe (106) being arranged with its longitudinal axis substantially vertically and within the classification apparatus housing (101, 103) and extending from below the separating wheel (111) down through the lower section (103) of the classification apparatus housing, a feed distributor (107) having a tip end directed downwards and arranged substantially concentrically with the inlet pipe (106) and the separating wheel, the feed distributor being dimensioned and arranged at a distance below the separating wheel and having a conic surface, the projection of the conic surface onto a plane defined by the bottom of the separating wheel having a larger diameter than any diameter of the separating wheel such that the feed of unclassified material is directed beyond the separating wheel (111), and the lower section (103) comprising a secondary classification zone, an upper portion of the secondary classification zone provides a secondary air inlet (105) arranged tangential to the circumference of the lower section (103) to supply secondary air in a direction cocurrently with the direction of rotation of the separating wheel (111).

2. The apparatus of claim 1 wherein the feed distributor (107) is somewhat cone-shaped and has a largest diameter which equals the external diameter of the separating wheel (111).

3. The apparatus of claim 1 wherein the feed distributor (107) is connected to the upper end of the inlet pipe (106) by at least two connecting elements (108).

4. The apparatus of claim 3 wherein the connecting elements comprise bars.

* * * * *